US006684833B2

(12) United States Patent
Moteki et al.

(10) Patent No.: US 6,684,833 B2
(45) Date of Patent: Feb. 3, 2004

(54) VARIABLE VALVE MECHANISM OF INTERNAL COMBUSTION ENGINE

(75) Inventors: Katsuya Moteki, Tokyo (JP); Shinichi Takemura, Yokohama (JP); Yoshiaki Miyazato, Kanagawa (JP)

(73) Assignees: Nissan Motor Co., Ltd., Yokohama (JP); Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/372,975

(22) Filed: Feb. 26, 2003

(65) Prior Publication Data

US 2003/0131813 A1 Jul. 17, 2003

Related U.S. Application Data

(62) Division of application No. 09/790,723, filed on Feb. 23, 2001.

(30) Foreign Application Priority Data

Feb. 24, 2000 (JP) ..... 2000-046872

(51) Int. Cl.[7] ..... F01L 1/34

(52) U.S. Cl. ..... 123/90.16; 123/90.15; 123/90.17

(58) Field of Search ..... 123/90.15, 90.16, 123/90.17

(56) References Cited

U.S. PATENT DOCUMENTS 5,988,125 A 11/1999 Hara et al.
6,019,076 A * 2/2000 Pierik et al. ..... 123/90.16
6,029,618 A 2/2000 Hara et al.
6,041,746 A 3/2000 Takemura et al.
6,055,949 A 5/2000 Nakamura et al.
6,123,053 A 9/2000 Hara et al.
6,260,523 B1 7/2001 Nakamura et al.
6,311,659 B1 * 11/2001 Pierik ..... 123/90.24

FOREIGN PATENT DOCUMENTS

JP 11-141321 A 5/1999

* cited by examiner

*Primary Examiner*—Thomas Denion
*Assistant Examiner*—Jaime Corrigan
(74) *Attorney, Agent, or Firm*—Foley & Lardner

(57) ABSTRACT

A swing cam to actuate engine valves is rotatably disposed about a drive shaft. A first eccentric cam is tightly disposed on the drive shaft. A ring-link is rotatably disposed on the first eccentric cam. A second eccentric cam is tightly disposed on a control shaft which rotates to a given angular position in accordance with an operation condition of an associated internal combustion engine. A rocker arm is rotatably disposed on the second eccentric cam. A rod-link extends between the rocker arm and the swing cam. A first connecting pin pivotally connects a first arm portion of the rocker arm with the ring-link. A second connecting pin pivotally connects a second arm portion of the rocker arm with an end of the rod-link. A third connecting pin pivotally connects the other end of the rod-link with the swing cam. The first connecting pin is fixed to either one of the first arm portion of the rocker arm and the ring-link.

10 Claims, 15 Drawing Sheets

VARIABLE VALVE MECHANISM OF INTERNAL COMBUSTION ENGINE

This application is a divisional application of U.S. patent application Ser. No. 09/790,723 filed on Feb. 23, 2001.

BACKGROUND OF THE INVENTION

1. Field of the Invention

The present invention relates to a variable valve mechanism of an internal combustion engine, which controls valve timing and valve lift of the engine in accordance with an operating condition of the engine.

2. Description of Related Art

Nowadays, variable valve mechanisms are commonly employed in automotive internal combustion engines for the superiority possessed by the mechanism. In fact, with the mechanism, fuel consumption and driveability under low speed and low load operation of the engine are both improved and at the same time, due to increased mixture charging efficiency, a sufficient output under high speed and high load operation of the engine is obtained.

SUMMARY OF THE INVENTION

According to a first aspect of the present invention, there is provided a variable valve mechanism of an internal combustion engine, which comprises a drive shaft driven by the engine; a control shaft extending in parallel with the drive shaft, the control shaft being rotatable about its axis to a given angular position in accordance with an operation condition of the engine; a swing cam rotatably disposed about the drive shaft, the swing cam actuating engine valves; a first eccentric cam tightly disposed on the drive shaft; a first link rotatably disposed on the first eccentric cam; a second eccentric cam tightly disposed on the control shaft; a rocker arm rotatably disposed on the second eccentric cam; a second link extending between the rocker arm and the swing cam; a first connecting pin through which a first arm portion of the rocker arm and the first link are pivotally connected; a second connecting pin through which a second arm portion of the rocker arm and an end of the second link are pivotally connected; and a third connecting pin through which the other end of the second link and the swing cam are pivotally connected, wherein the first connecting pin is fixed to either one of the first arm portion of the rocker arm and the first link.

According to a second aspect of the present invention, there is provided a variable valve mechanism of an internal combustion engine, which comprises a drive shaft driven by the engine; a control shaft extending in parallel with the drive shaft, the control shaft being rotatable about its axis to a given angular position in accordance with an operation condition of the engine; a swing cam rotatably disposed about the drive shaft, the swing cam actuating engine valves; a first eccentric circular cam tightly and eccentrically disposed on the drive shaft; a first link rotatably disposed on the first eccentric circular cam; a second eccentric circular cam tightly and eccentrically disposed on the control shaft; a rocker arm rotatably disposed on the second eccentric circular cam; a second link extending between the rocker arm and the swing cam; a first connecting pin through which a first arm portion of the rocker arm and the first link are pivotally connected; means for pivotally connecting a second arm portion of the rocker arm with an end of the second link; and means for pivotally connecting the other end of the second link with the swing cam, wherein the first connecting pin is fixed to either one of the first arm portion of the rocker arm and the first link.

The other objects and advantages of the present invention will become understood from the following description with reference to the accompanying drawings.

DETAILED DESCRIPTION OF THE EMBODIMENTS

In order to clarify the task of the present invention, a related variable valve mechanism shown in Japanese Laid-open Patent Application 11-141321 will be briefly described with reference to FIG. 15 of the accompanying drawings.

Figure 15:
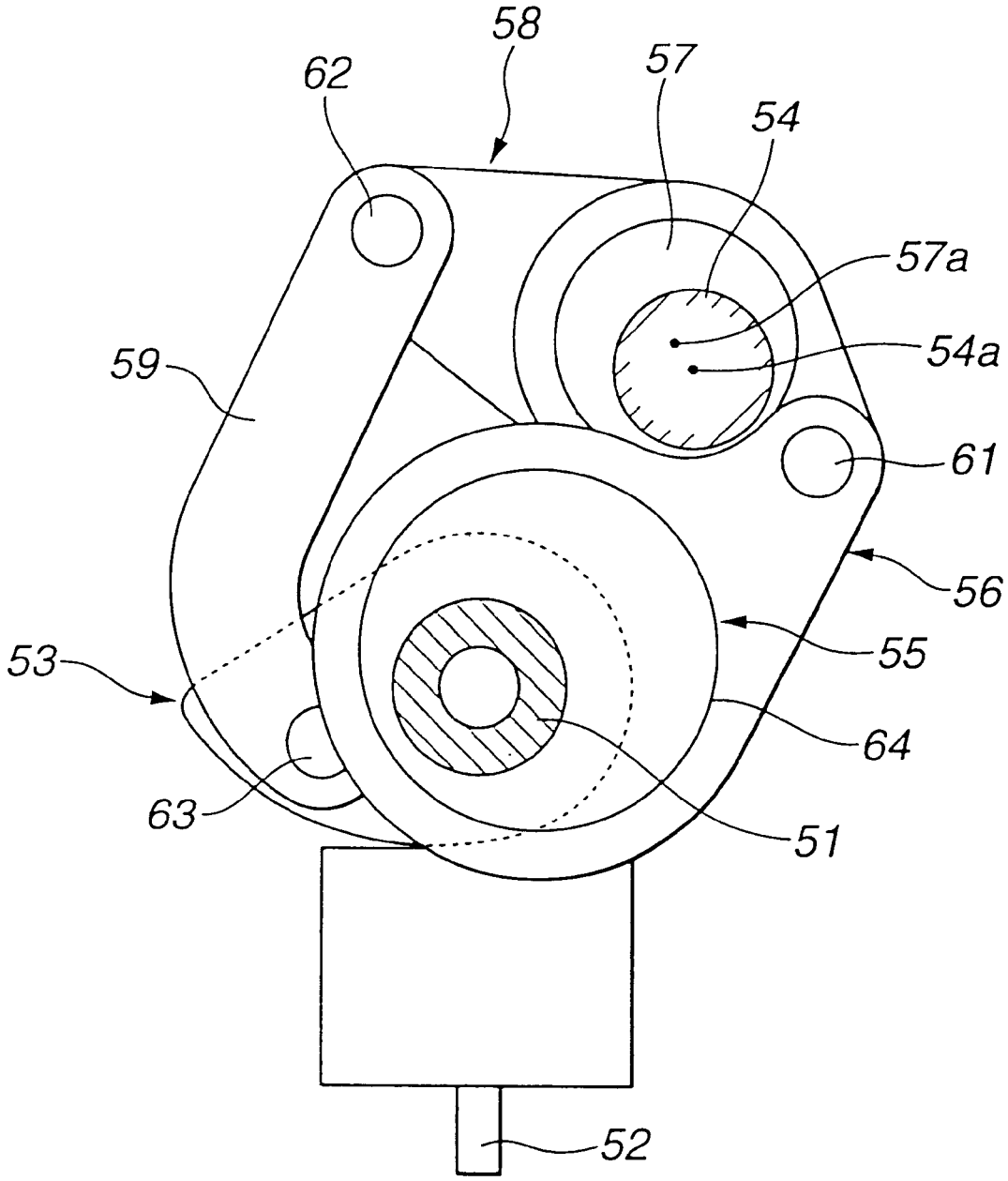
FIG.15 (RELATED ART)
FIG. 15 is a sectional view of a related variable valve mechanism shown in Japanese Laid-open Patent Application 11-141321.

As shown in FIG. 15, the variable valve mechanism generally comprises a drive shaft 51 rotated together with a crankshaft (not shown) of an internal combustion engine, a swing cam 53 rotatably disposed on the drive shaft 51 to actuate intake (or exhaust) valves 52, a control shaft 54 extending in parallel with the drive shaft 51 and a link mechanism for linking the drive shaft 51 and the swing cam 53 through the control shaft 54. The link mechanism comprises a first eccentric cam 55 fixed to the drive shaft 51 and a ring-shaped link (or ring-link) 56 rotatably disposed on the first eccentric cam 55. A second eccentric cam 57 is fixed to the control shaft 54, and a rocker arm 58 is rotatably disposed on the second eccentric cam 57. A projected end of the ring-link 56 and one end of the rocker arm 58 are pivotally connected through a first connecting pin 61, and the other end of the rocker arm 58 and the swing cam 53 are pivotally connected through a rod-shaped link (or rod-link) 59. That is, the other end of the rocker arm 58 and one end of the rod-link 59 are pivotally connected through a second connecting pin 62 and the other end of the rod-link 59 and the swing cam 53 are pivotally connected through a third connecting pin 63. Denoted by 57*a* is a center of the second eccentric cam 57, about which the rocker arm 58 swings. Denoted by numeral 54*a* is a center of the control shaft 54. Thus, when, under operation of the associated engine, the control shaft 54 is rotated to a certain angular position, the center 57*a* of the second eccentric cam 57 is displaced relative to the center 54*a* of the control shaft 54 thereby to change the lifting characteristic of the intake valves 52. For achieving a smoothed pivoting between the mutually connected elements (viz., 56 and 58, 58 and 59, or 59 and 53), the first, second and third connecting pins 61, 62 and 63 are each arranged to show a free rotation relative to both the mutually connected elements. That is, each connecting pin 61, 62 or 63 is rotatable to both the mutually connected elements associated thereto. This means that there is inevitably defined a radial clearance between the pin 61, 62 or 63 and an inner wall of a cylindrical bore formed in each of the mutually connected elements.

However, as is known, determining ideal dimensions of such radial clearance is very difficult and at least troublesome. In fact, if the dimensions are not properly made, out-of alignment between the mutually connected elements tends to occur, which may cause an undesirable unsymmetrical wear of a bearing portion such as the portion indicated by the arrow 64.

Thus, it is an object of the present invention to provide a variable valve mechanism of an internal combustion engine, which is free of the above-mentioned undesired unsymmetrical wear of the bearing portion.

In the following, various embodiments 100A to 100F of the present invention will be described with reference to the accompanying drawings. For ease of understanding, various directional terms, such as right, left, upper, lower, upward, downward and the like are used in the description. However, these terms are to be understood with respect to only the drawing or drawings in which a corresponding element or portion is illustrated.

Figure 1:
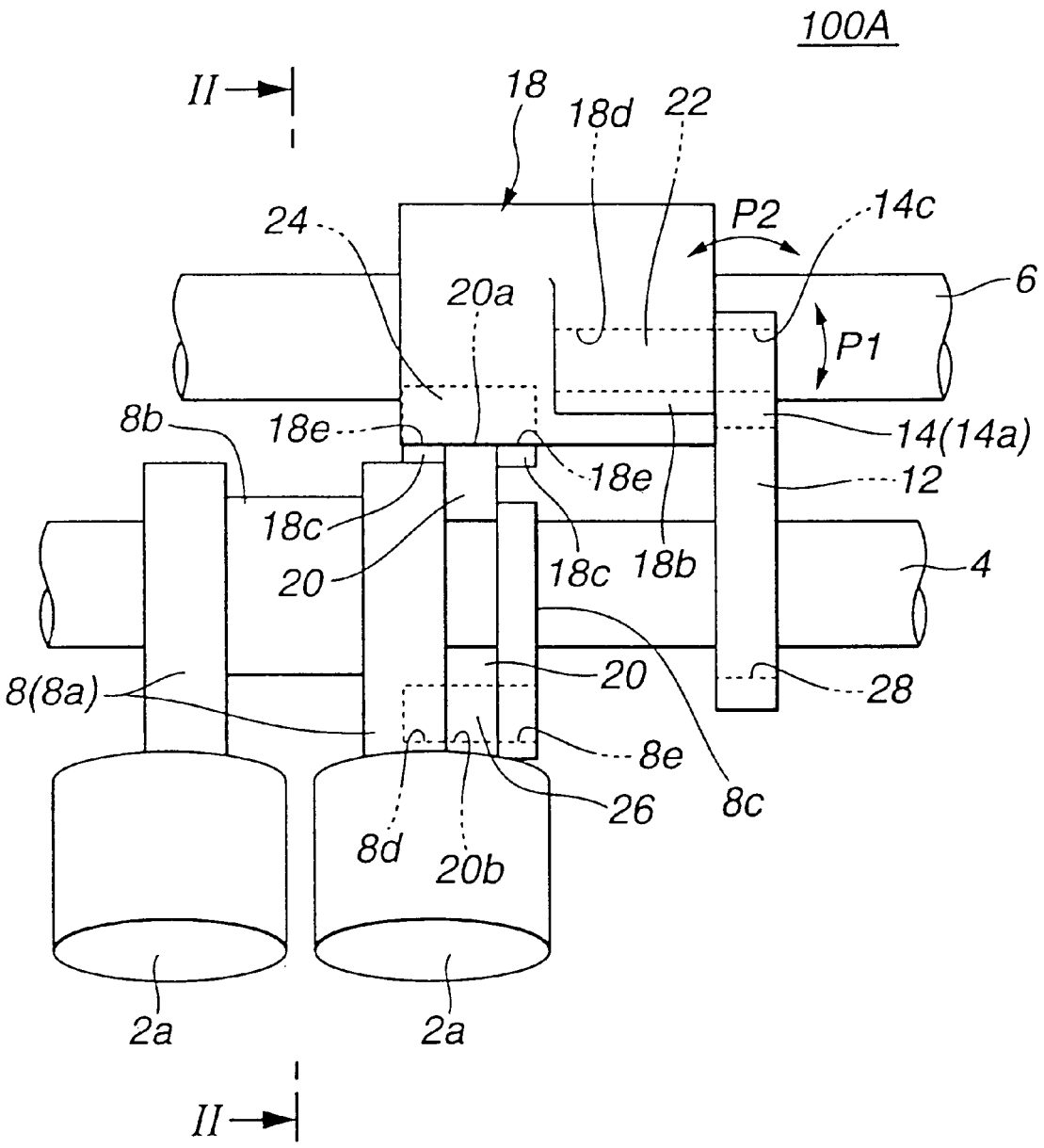
FIG. 1 is a schematic view of a variable valve mechanism which is a first embodiment of the present invention.
Figure 2:
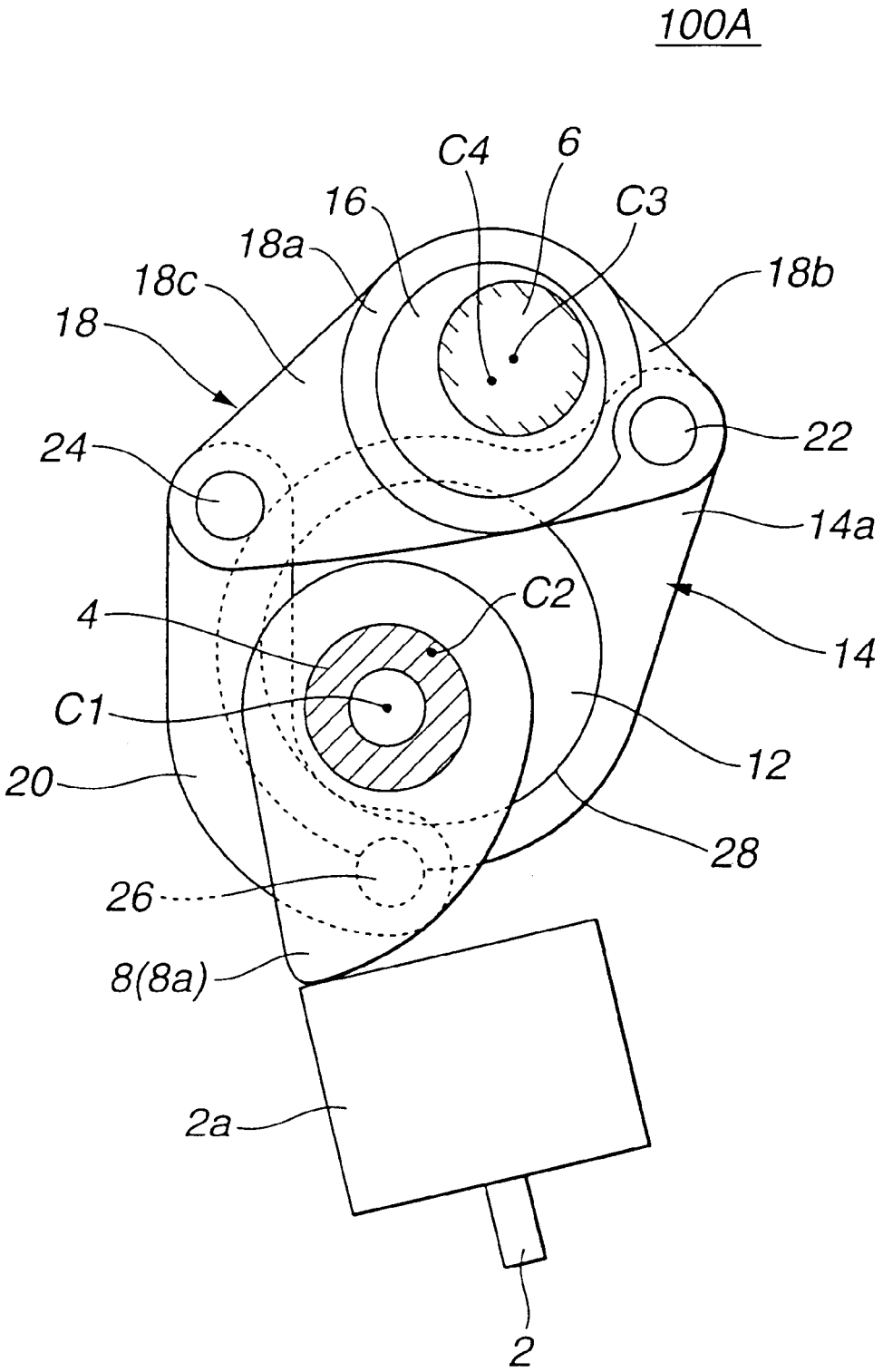
FIG. 2 is a sectional view taken along the line II—II of FIG. 1.

Referring to FIGS. 1 and 2, there is shown a variable valve mechanism 100A which is a first embodiment of the present invention. The mechanism 100A is designed to be applicable to an internal combustion engine having in each cylinder two intake valves 2 and two exhaust valves (not shown).

As is seen from the drawings, above valve lifters 2*a* of the intake valves 2 of the engine, there extends a drive shaft 4. The drive shaft 4 extends in a direction along which the cylinders of the engine aligned. A sprocket (not shown) is fixed to one end of the drive shaft 4, which is powered or driven by a crankshaft (not show) through a timing chain (not shown). The drive shaft 4 is formed with axially extending oil passages through which lubrication oil flows.

As is seen from FIG. 2, above the drive shaft 4, there is arranged a control shaft 6 which extends in parallel with the drive shaft 4. An actuator (not shown) is associated with the control shaft 6 to change and control an angular position of the same in accordance with an operation condition of the engine. The control shaft 6 is formed with axially extending oil passages, like the above-mentioned drive shaft 4.

About the drive shaft 4, there is swingably or pivotally disposed a swing cam 8 for each cylinder, which actuates the intake valves 2 to open and close the same.

As is seen from FIG. 1, the swing cam 8 comprises a pair of lobe portions 8*a* and 8*a* which slidably contact the valve lifters 2*a* and 2*a* and a cylindrical bearing portion 8*b* interposed between the lobe portions 8*a* and 8*a*. The bearing portion 8*b* and the control shaft 6 are rotatably held by a bracket (not shown) fixed to a cylinder head (not shown) of the engine.

As will become apparent as the description proceeds, in the variable valve mechanism 100A, the drive shaft 4 and the swing cam 8 are timely and mechanically connected through the control shaft 6. That is, under operation of the variable valve mechanism 100A, the intake valves 2 are forced to open and close at a predetermined cycle in accordance with rotation of the drive shaft 4 and the lifting characteristic of each valve 2 is controlled in accordance with an angular position assumed by the control shaft 6.

As is seen from the drawings, particularly from FIG. 2, the variable valve mechanism 100A comprises a first eccentric circular cam 12 (which will be referred to first eccentric cam hereinafter) tightly and eccentrically disposed on the drive shaft 4, a ring-shaped link (which will be referred to ring-link or first link hereinafter) 14 rotatably disposed on the first eccentric cam 12, a second eccentric circular cam (which will be referred to second eccentric cam hereinafter) 16 tightly and eccentrically disposed on the control shaft 6, a rocker arm 18 rotatably disposed on the second eccentric cam 16 and a rod-shaped link (which will be referred to rod-link or second link hereinafter) 20 pivotally connected to both the rocker arm 18 and the swing cam 8.

The first eccentric cam 12 is fixed to the drive shaft 4 by means of press fitting. As is seen from FIG. 2, a center C2 of the first eccentric cam 12 is displaced from a center C1 of the drive shaft 4 by a given distance. As is seen from FIG. 1, the ring-link 14 has substantially the same thickness as the first eccentric cam 12, and as is seen from FIG. 2, the ring-link 14 has a projected portion 14*a* projected radially outward. Designated by numeral 28 is a sliding bearing portion at which an outer periphery of the first eccentric cam 12 and an inner periphery of the ring-link 14 slidably contact to each other.

The second eccentric cam 16 is fixed to the control shaft 6 by means of press fitting. As is seen from FIG. 2, a center C4 of the second eccentric cam 16 is displaced from a center C3 of the control shaft 6 by a given distance. The rocker arm 18 is of a bell crank type, and as is seen from FIGS. 1 and 2, the rocker arm 18 comprises a cylindrical middle portion 18*a* which is tightly disposed on the second eccentric cam 16 and first and second arm portions 18*b* and 18*c* which extend radially outward from the cylindrical middle portion 18*a* in opposite directions. As is seen from FIG. 1, the first and second arm portions 18*b* and 18*c* are offset in the axial direction. The second eccentric cam 16 and the rocker arm 18 are arranged in the vicinity of a unit consisting of the first eccentric cam 12 and the ring-link 14.

As is seen from the drawings, the first arm portion 18*b* of the rocker arm 18 and the projected portion 14*a* of the ring-link 14 are pivotally connected through a first connecting pin 22, the second arm portion 18*c* of the rocker arm 18 and an end portion of the rod-link 20 are pivotally connected through a second connecting pin 24, and the other end portion of the rod-link 20 and the swing cam 8 are pivotally connected through a third connecting pin 26.

When, due operation of the engine, the drive shaft 4 is rotated, the ring-link 14 is moved through the eccentric cam 18, and thus, the rocker arm 18 is swung about the center C4 of the second eccentric cam 16 and at the same time the swing cam 8 is swung through the rod-link 20. During this, the valve lifters 2*a* are intermittently pressed by the swing cam 8 against forces of valve springs (not shown), and thus the intake valves 2 are subjected to OPEN/CLOSE operation in accordance with the operation of the engine. When now the control shaft 6 is rotated to assume a certain angular position, the center C4 of the second eccentric cam 16 that serves as a pivot center of the rocker arm 18 is displaced thereby continuously changing the lifting characteristic of the intake valves 2. As the center C4 of the second eccentric cam 16 nears the center C1 of the drive shaft 4, the lift and operating angle of the valves 2 increase.

As is mentioned hereinabove, in the variable valve mechanism 100A, the swing cam 8 actuating the intake valves 2 is pivotally disposed on the drive shaft 4 which is rotated in accordance with operation of the engine. Thus, undesired center displacement of the swing cam 8 relative to the drive shaft 4 is suppressed and thus the control accuracy is increased. Furthermore, since the drive shaft 4 serves as a support shaft for the swing cam 8, there is no need of providing a separate shaft for the swing cam 8. Thus, number of parts used is reduced and the mechanism 100A can be made compact in size. Furthermore, almost of the parts are connected to one another through a so-called surface-to-surface connection, they can exhibit a satisfied resistance against abrasion and facilitate a lubrication.

In this first embodiment 100A, the first connecting pin 22 is secured to the first arm portion 18*b* of the rocker arm 18 (or the projected portion 14*a* of the ring-link 14) by means of press fitting. That is, the first arm portion 18*b* is formed with a fitting bore 18*d* into which the first connecting pin 22 is press fitted. That is, under such condition as shown in FIG. 1, the clearance between the first connecting pin 22 and the fitting bore 18*d* is substantially 0 (zero).

While, the connection between the first connecting pin 22 and the ring-link 14 is pivotally made. That is, the projected portion 14*a* of the ring-link 14 is formed with a bearing bore 14*c* in which an outer end of the first connecting pin 22 is rotatably received. That is, under the condition of FIG. 1, a certain but very small clearance is defined between the first connecting pin 22 and the bearing bore 14*c*.

As is seen from FIG. 1, the second arm portion 18*c* of the rocker arm 18 has forked ends which have aligned bearing bores 18*e* and 18*e*. The end portion of the rod-link 20 is put between the forked ends of the rocker arm 18 and has a bearing bore 20*a* mated with the aligned bearing bores 18*e* and 18*e*. The second connecting pin 24 is rotatably received in the aligned three bores 18*e*, 20*a* and 18*e*. That is, under the condition of FIG. 1, a certain but very small clearance is defined between the second connecting pin 24 and each of the bores 18*e*, 20*a* and 18*e*. More specifically, the second connecting pin 24 is rotatable relative to both the rocker arm 18 and the rod-link 20. However, if desired, the second connecting pin 24 may be fixed to either one of the rocker arm 18 and the rod-link 20.

The other end portion of the rod-link 20 is formed with a bearing bore 20*b*, one of the lobe portions 8*a* of the swing cam 8 is formed with a bearing bore 8*d* and an auxiliary holding portion 8*c* of the swing cam 8 is formed with a bearing bore 8*e*. As shown in FIG. 1, these three bores 8*d*, 20*b* and 8*e* are aligned and the third connecting pin 26 is rotatably received in these aligned bores 8*d*, 20*b* and 8*e*. That is, under the condition of FIG. 1, a certain but very small clearance is defined between the third connecting pin 26 and each of the bores 8*d*, 20*b* and 8*e*. More specifically, the third connecting pin 26 is rotatable relative to both the rod-link 20 and the swing cam 8. However, if desired, the third connecting pin 26 may be fixed to either one of the rod-link 20 and the swing cam 8.

That is, in the variable valve mechanism 100A of this first embodiment, in all the connections between the pins 22, 24 and 26 and the parts 8, 14, 18 and 20, only the connection between the first connecting pin 22 and the first arm portion 18*b* of the rocker arm 18 is fixedly made, and the other connections are all pivotally or rotatably made.

Due to the fixed connection between the first connecting pin 22 and the first arm portion 18*b* of the rocker arm 18, the following advantages are expected. That is, even when, like in valve lifting, a certain load is transmitted between rocker arm 18 and the ring-link 14 through the first connecting pin 22, undesired slant phenomenon of the first connecting pin 22 in the direction of the arrow P1 and that of the ring-link 14 in the direction of the arrow P2 are suppressed. Thus, undesired unsymmetrical wear of the bearing portion 28 between the ring-link 14 and the first eccentric cam 12 is suppressed or at least minimized. Furthermore, due to the fixed connection between the pin 22 and the rocker arm 18, the movement of the ring-link 14 is reliably transmitted to the rocker arm 18 and thus to the swing arm 8, and thus undesired dislocation of the swing arm 8 along the drive shaft 4 is suppressed or at least minimized. Furthermore, due to the adjacent arrangement of the rocker arm 18 and the ring-link 14 in the axial direction by which mutually facing surfaces thereof contact to each other, undesired slant phenomenon of the link 14 is suppressed. In the variable valve mechanism 100A, an arrangement is employed in which the moving degree gradually increases with increase of force travelling path from the ring-link 14 to the swing cam 8. Thus, if the connection between the first connecting pin 22 and the rocker arm 18 is poorly made, the swing arm 8 would suffer from a marked displacement. However, the fixed connection of the first connecting pin 22 to the rocker arm 18 suppresses such drawback.

Usually, in case of press fitting a pin into a bore formed in a member, a wall of the bore is reinforced considering a marked stress which would be applied to the wall upon the fitting. Normally, for such reinforcement, a portion of the member where the bore is provided is increased in size. In the embodiment 100A of the invention, the length of the first connecting pin 22 that is actually put in the fitting bore 18*d* is longer than that of the other connecting pin 24 or 26. This brings about increase in weight or mass of the connecting pin 22, and thus increase in inertia load of the same under operation of the variable valve mechanism 100A.

Figure 3:
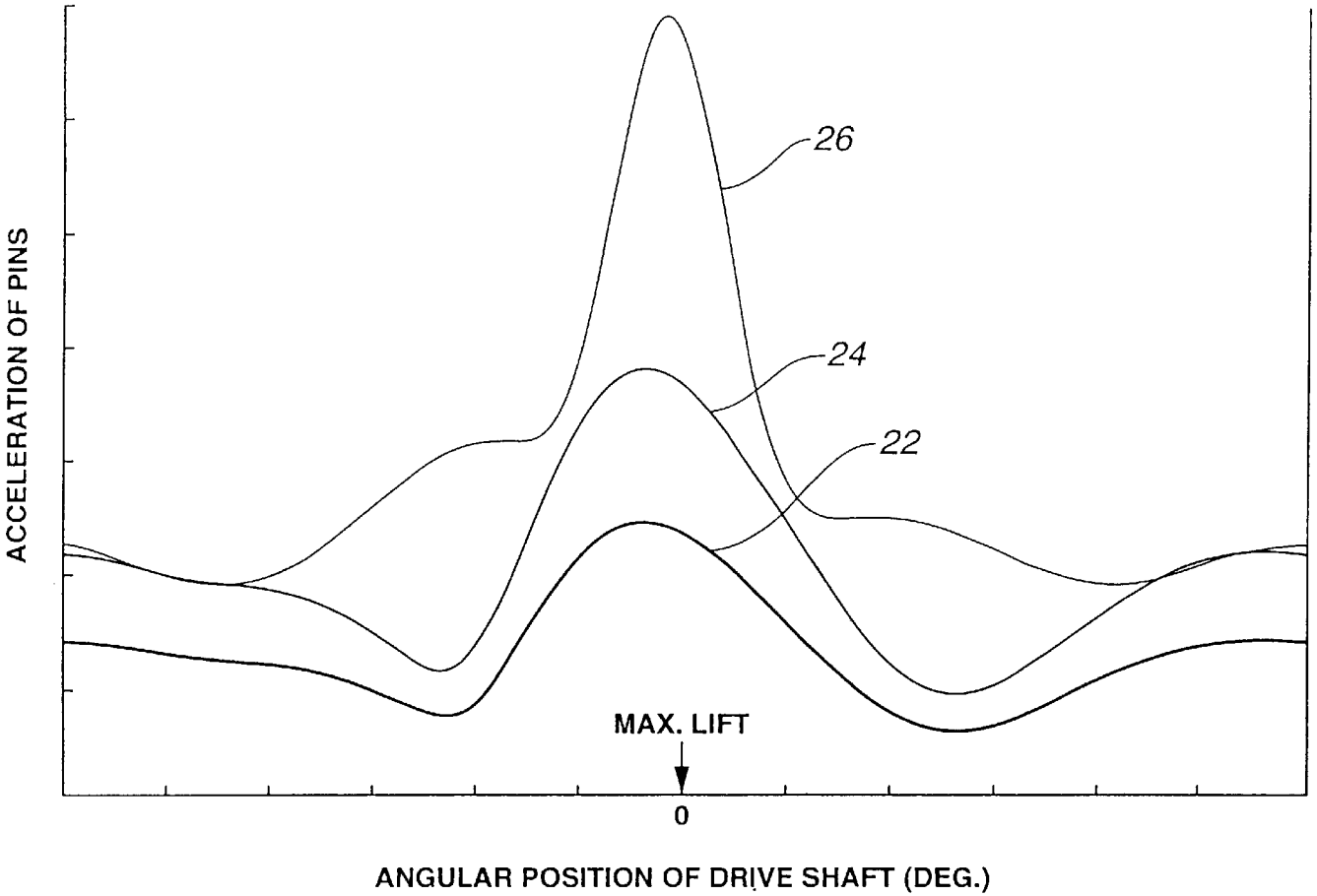
FIG. 3 is a graph showing acceleration of first, second and third connecting pins employed in the mechanism of the first embodiment.

As is known, the inertia load tends to increase with increase of acceleration of the connecting pin. While, as is seen from the graph of FIG. 3, in the variable valve mechanism 100A of the first embodiment, the first connecting pin 22 shows the smallest acceleration in the three pins 22, 24 and 26. The first connecting pin 22 is fixed to the rocker arm 18 as is described hereinabove, and thus, increase in inertia load caused by the fixing of the pin 22 to the rocker arm 18 is controlled relatively low as compared with that of the other pin 24 or 26.

In the first embodiment 100A, the longer side of the first connecting pin 22 is tightly fitted in the fitting bore 18*d* of the rocker arm 18 and the shorter side of the pin 22 is rotatably received in the bearing bore 14*c* of the ring-link 14. This arrangement brings about increase in supporting rigidity to the pin 22 as compared with a reversed case wherein the longer side is rotatably received in the bore 18*d* and the shorter side is tightly fitted in the bore 14*c*. Thus, undesired slant phenomenon of the ring-link 14 is suppressed.

In the following, other embodiments 100B, 100C, 100D, 100E and 100F of the invention will be described. Since these embodiments are similar in construction to the above-mentioned first embodiment 100A, only parts and/or portions that are different from those of the first embodiment 100A will be described in detail. Substantially the same parts and/or portions will be denoted by the same numerals as those of the first embodiment 100A.

Figure 4:
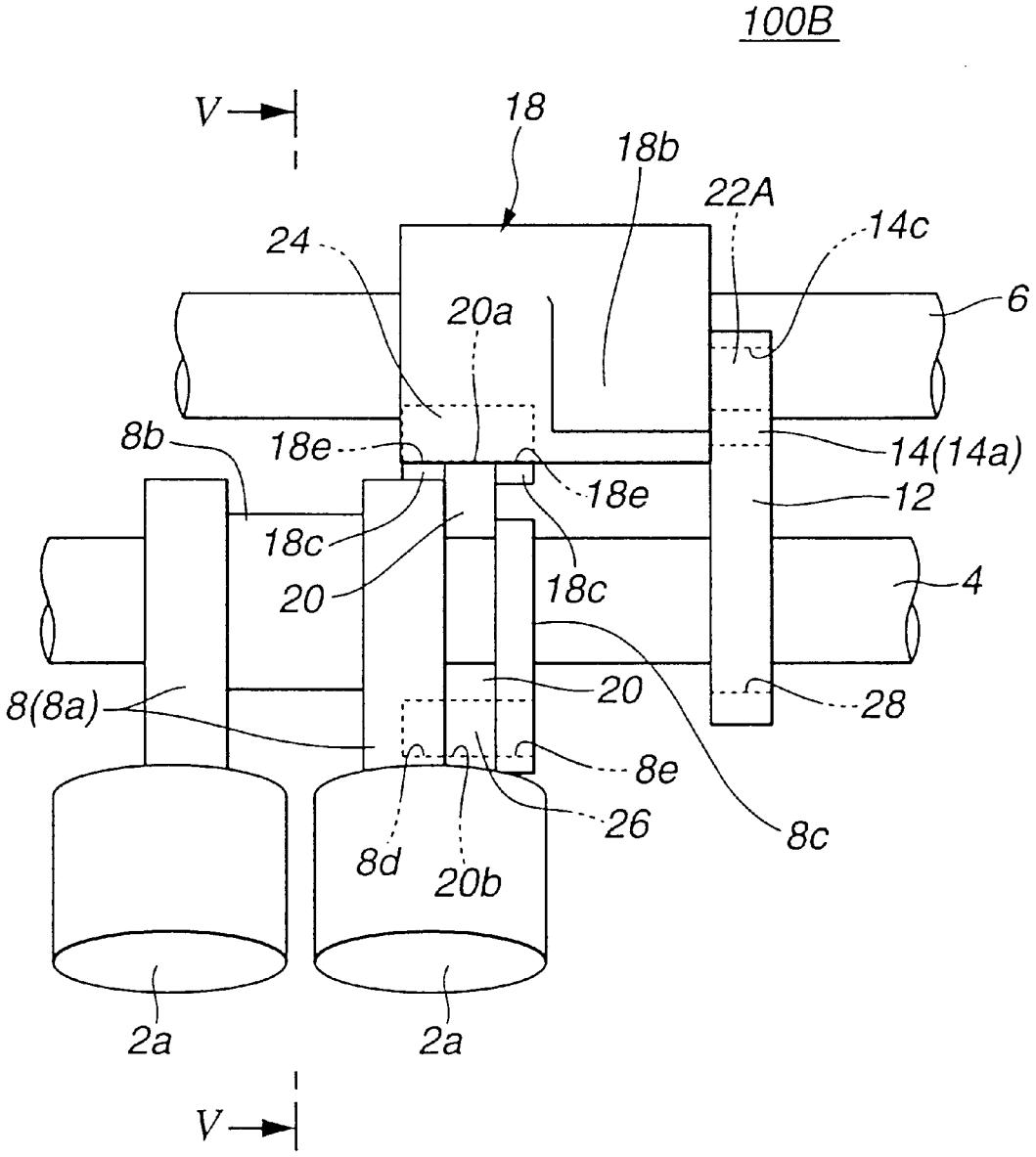
FIG. 4 is a view similar to FIG. 1, but showing a second embodiment of the present invention.
Figure 5:
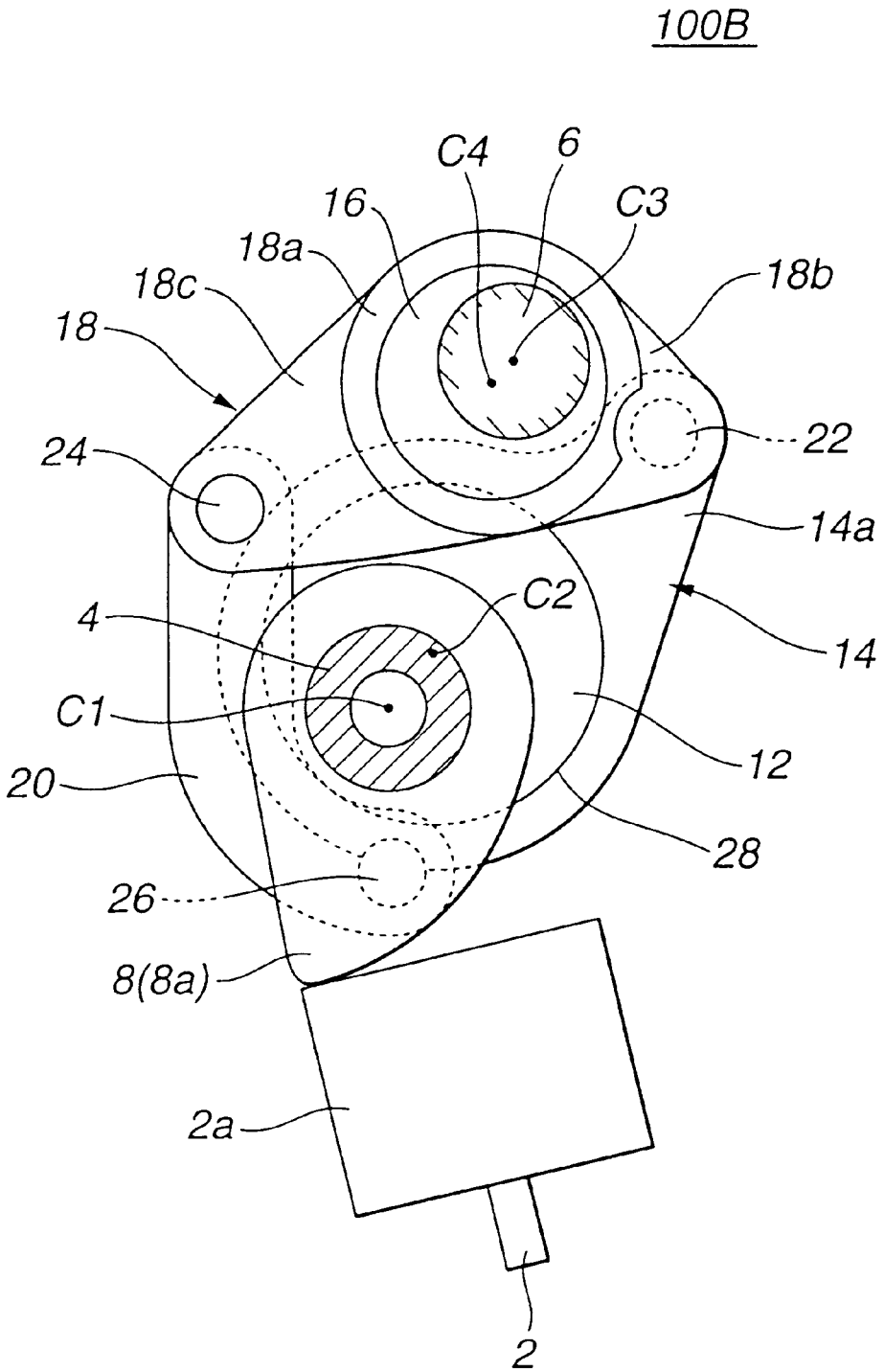
FIG. 5 is a sectional view taken along the line V—V of FIG. 4.

Referring to FIGS. 4 and 5, there is shown a variable valve mechanism 100B which is a second embodiment of the present invention.

In this second embodiment 100B, the first connecting pin 22A is integral with the rocker arm 18. That is, the integral pin 22A projected from the first arm portion 18*b* of the rocker arm 18 has a leading end rotatably received in the bearing bore 14*c* of the ring-link 14.

The mechanism 100B of this second embodiment has substantially the same advantages as those of the above-mentioned first embodiment 100A. Besides, due to non-necessity of the press-fitting of the first connecting pin to the rocker arm 18, productivity of the mechanism 100B increases. Furthermore, due to the integral connection of the pin 22A with the rocker arm 18, the supporting rigidity to the pin is much increased.

Figure 6:
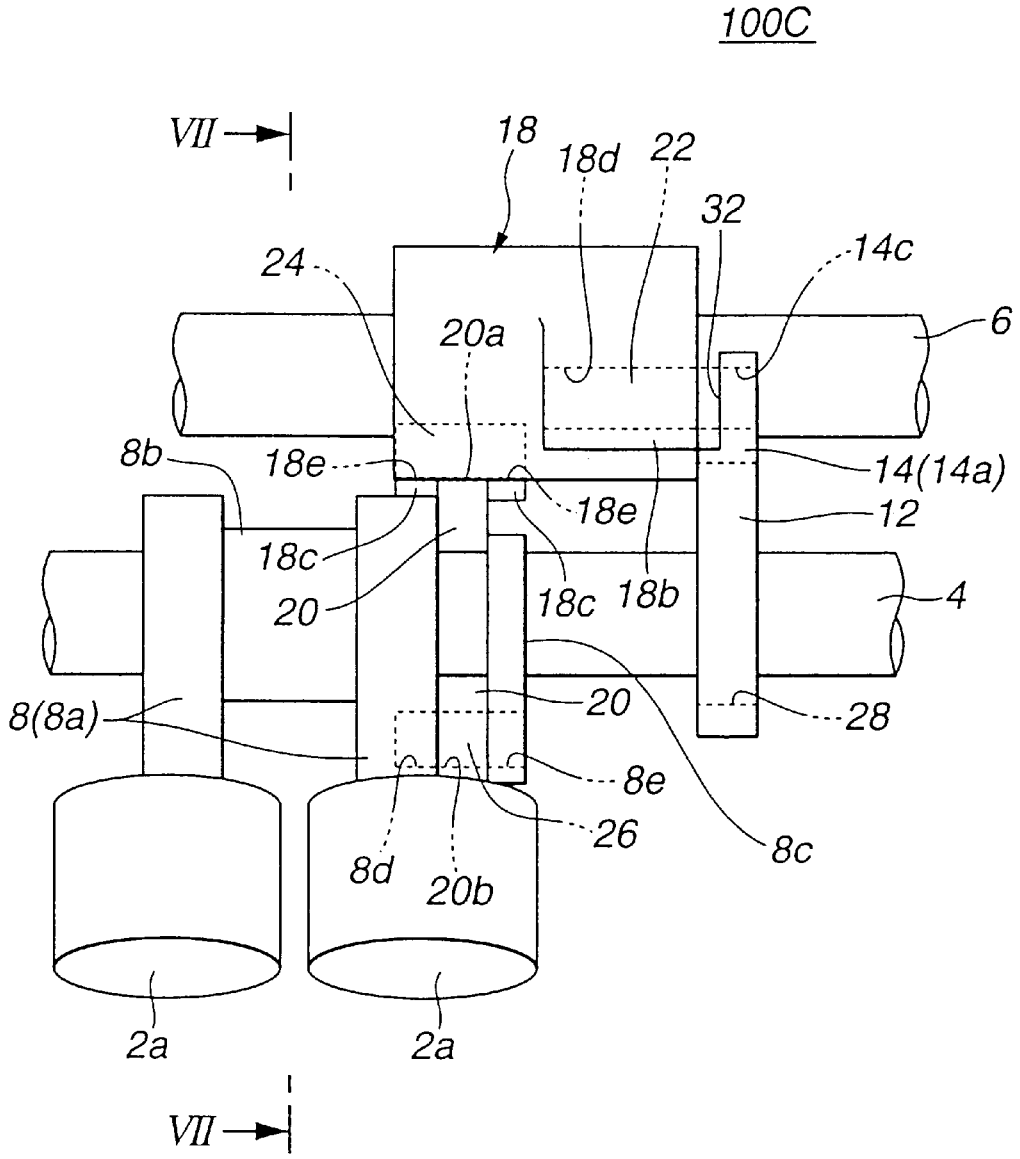
FIG. 6 is a view similar to FIG. 1, but showing a third embodiment of the present invention.
Figure 7:
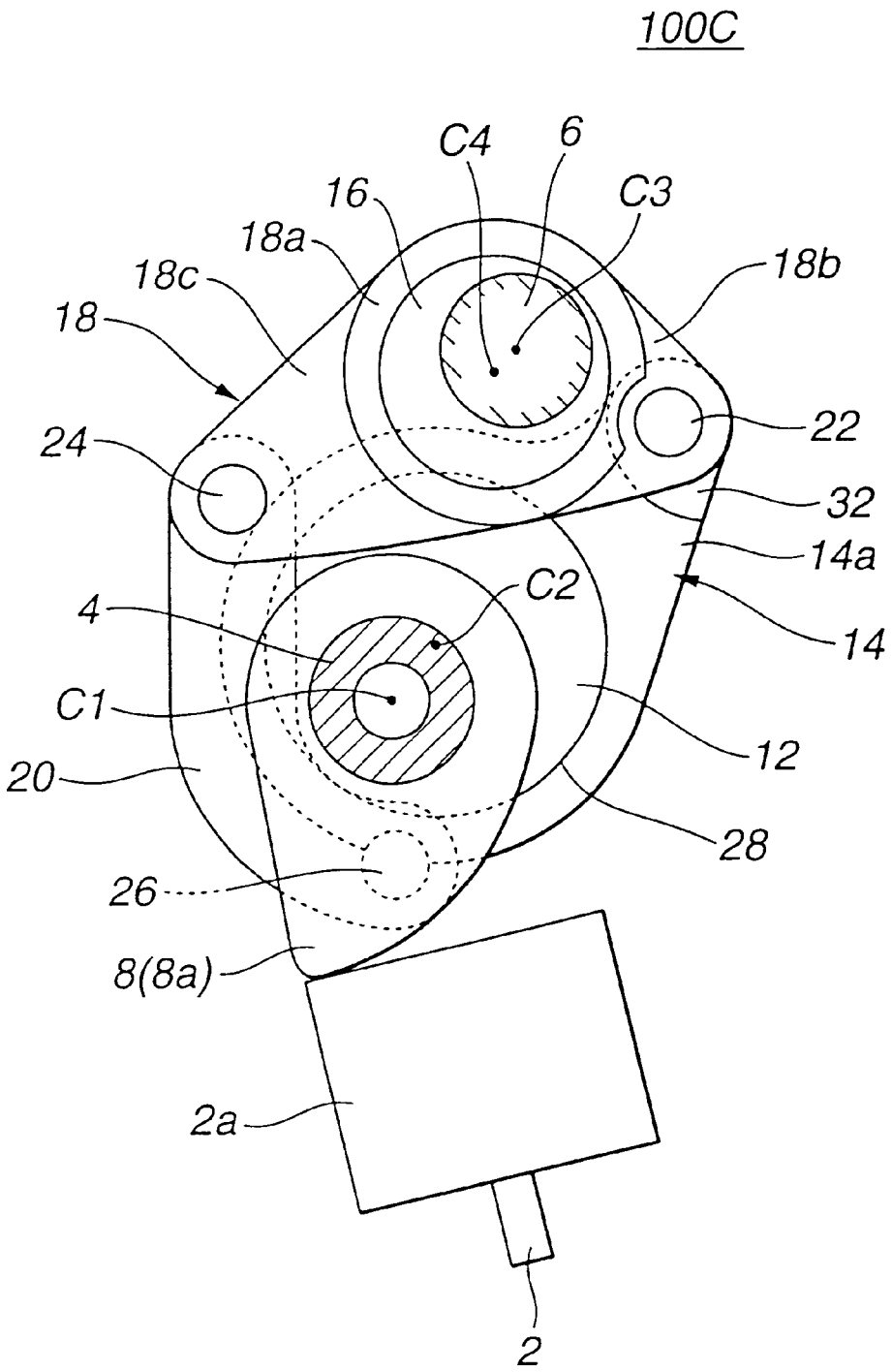
FIG. 7 is a sectional view taken along the line VII—VII of FIG. 6.

Referring to FIGS. 6 and 7, there is shown a variable valve mechanism 100C which is a third embodiment of the present invention.

Figure 8A:
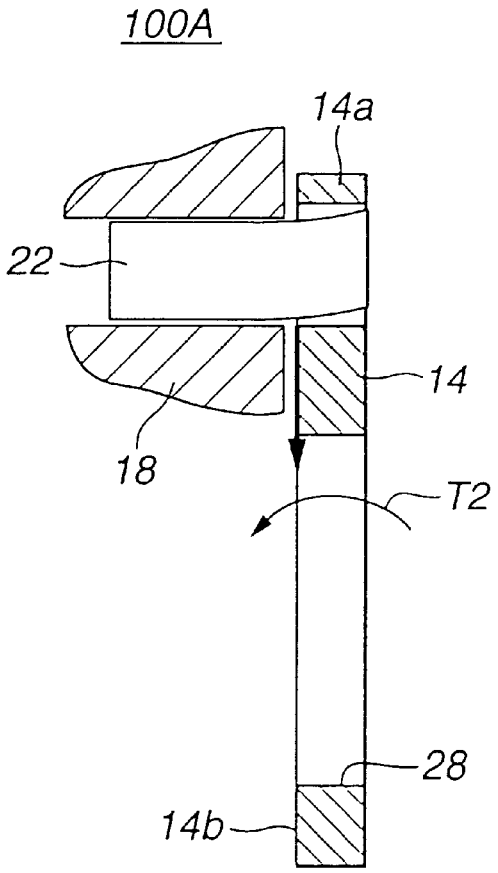
FIGS. 8A and 8B are illustrations for explaining operation of the mechanisms of the first and third embodiments.
Figure 8B:
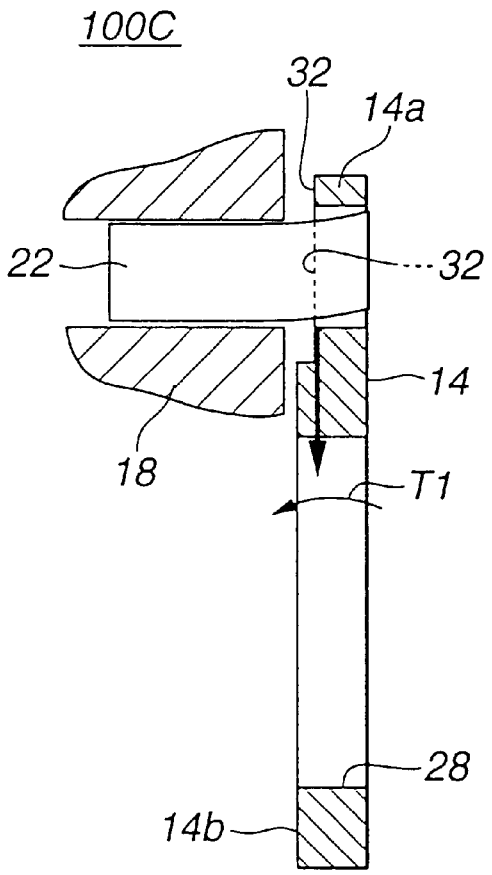

In this third embodiment 100C, as is seen from FIGS. 6 and 8B, an offset surface area (viz., flat cut) 32 is provided by the ring-link 14 which faces the inlet portion of the fitting bore 18*d* of the rocker arm 18. Thus, as is seen from the drawings, a part of the first connecting pin 22 is viewed from the outside through the offset surface area 32.

The advantage given by this third embodiment 100C will be described with reference to FIGS. 8A and 8B. For ease of understanding, also the mechanism 100A of the first embodiment is shown in FIG. 8A and in the drawings of FIGS. 8A and 8B, deformation of the first connecting pin 22 is exaggeratingly illustrated.

When, under operation of the associated engine, a certain load is applied to the first connecting pin 22 due to the torque transmission from the ring-link 14 to the rocker arm 18, the pin 22 is subjected to an elastic deformation as is shown in the drawings. Under this condition, in case of the third embodiment 100C of FIG. 8B, the position where the load is directly applied from the pin 22 to the link 14 is shifted away or offset from the rocker arm 18 by a degree corresponding to the depth of the offset surface area 32, as compared with case of the first embodiment 100A of FIG. 8A. This means that in the third embodiment 100C, a torque T1 applied to the bearing portion 28 is smaller than a torque T2 in case of the first embodiment 100A. Thus, undesired unsymmetrical wear of the bearing portion 28 is much effectively suppressed in the third embodiment 100C.

Figure 9:
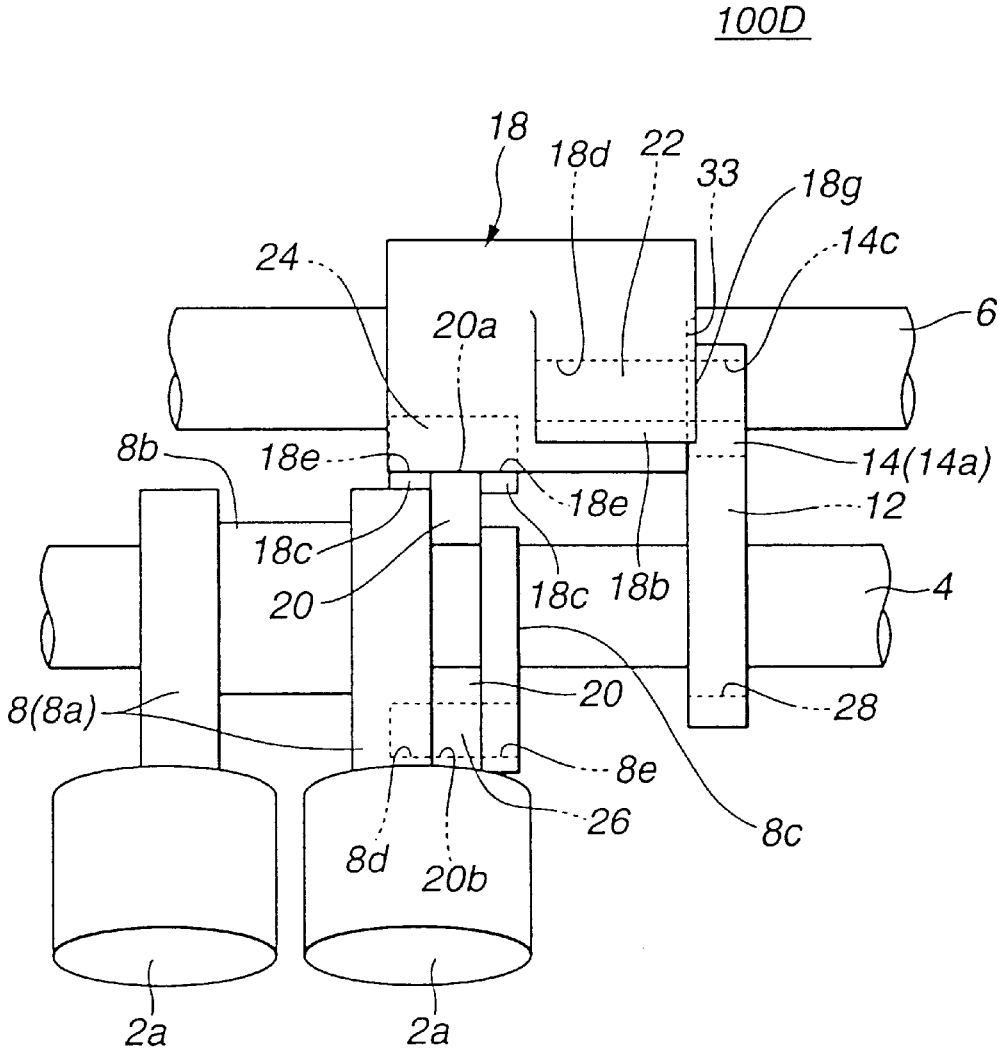
FIG. 9 is a view similar to FIG. 1, but showing a fourth embodiment of the present invention.

Referring to FIG. 9, there is shown a variable valve mechanism 100D which is a fourth embodiment of the present invention.

The mechanism 100D of this fourth embodiment is substantially the same as that 100C of the third embodiment except the shape of the rocker arm 18. That is, in the fourth embodiment 100D, a right surface 18*g* of the rocker arm 18 that faces the offset surface area 32 of the ring-link 14 is projected toward the ring-link 14 by a distance corresponding to the depth of the offset surface area 32. That is, the right surface 18*g* is slidably contactable with the bottom of the offset surface area 32. In order to prevent interference between the ring-link 14 and each of the rocker arm 18 and the second eccentric cam 16, the rocker arm 18 and the second eccentric cam 16 have flat cuts 33 at the surfaces facing the ring-link 14.

Because having both the features of the above-mentioned first and third embodiments 100A and 100C, the mechanism 100D of this fourth embodiment has the same advantages of such embodiments 100A and 100C.

Figure 10:
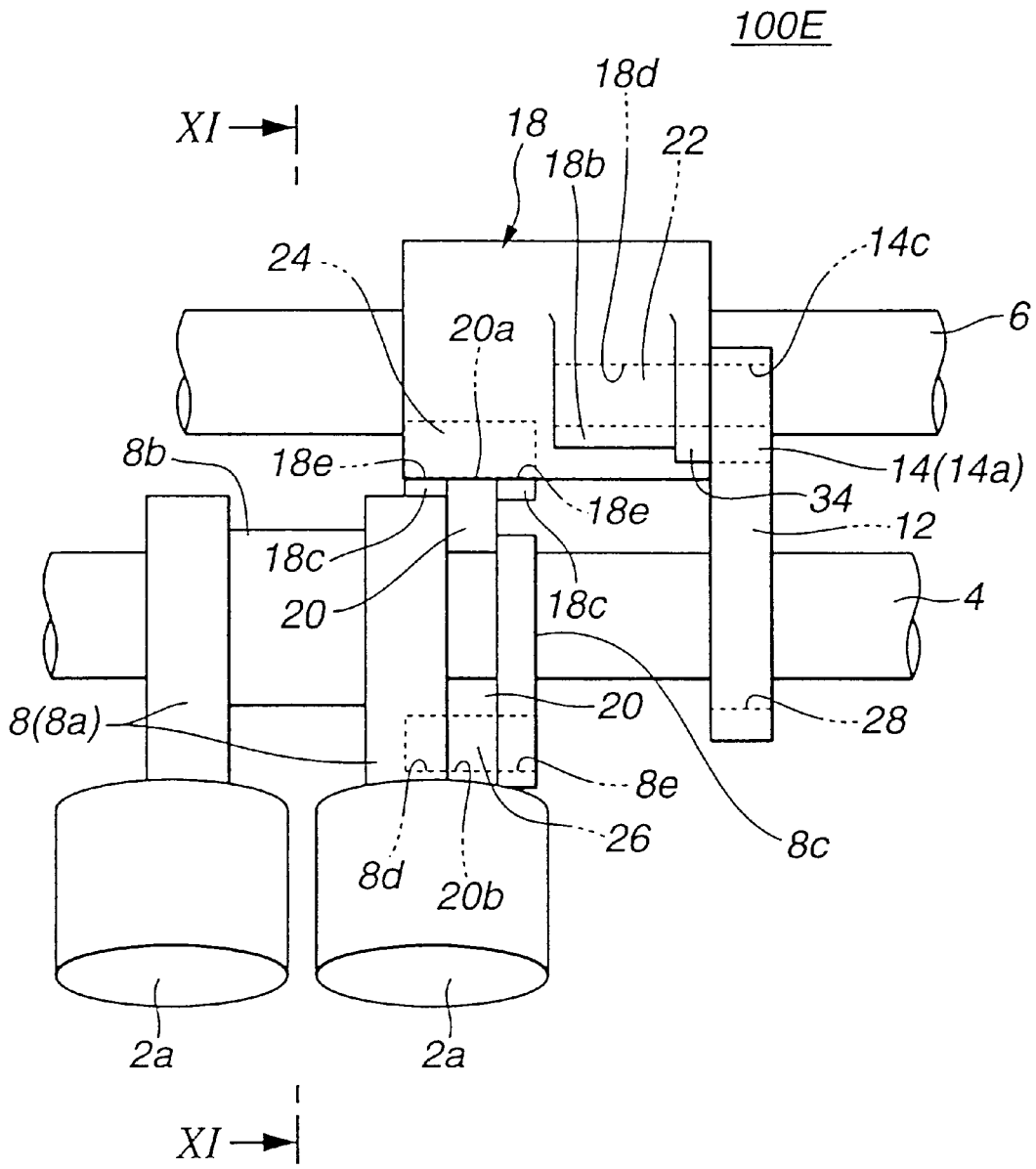
FIG. 10 is a view similar to FIG. 1, but showing a fifth embodiment of the present invention.
Figure 11:
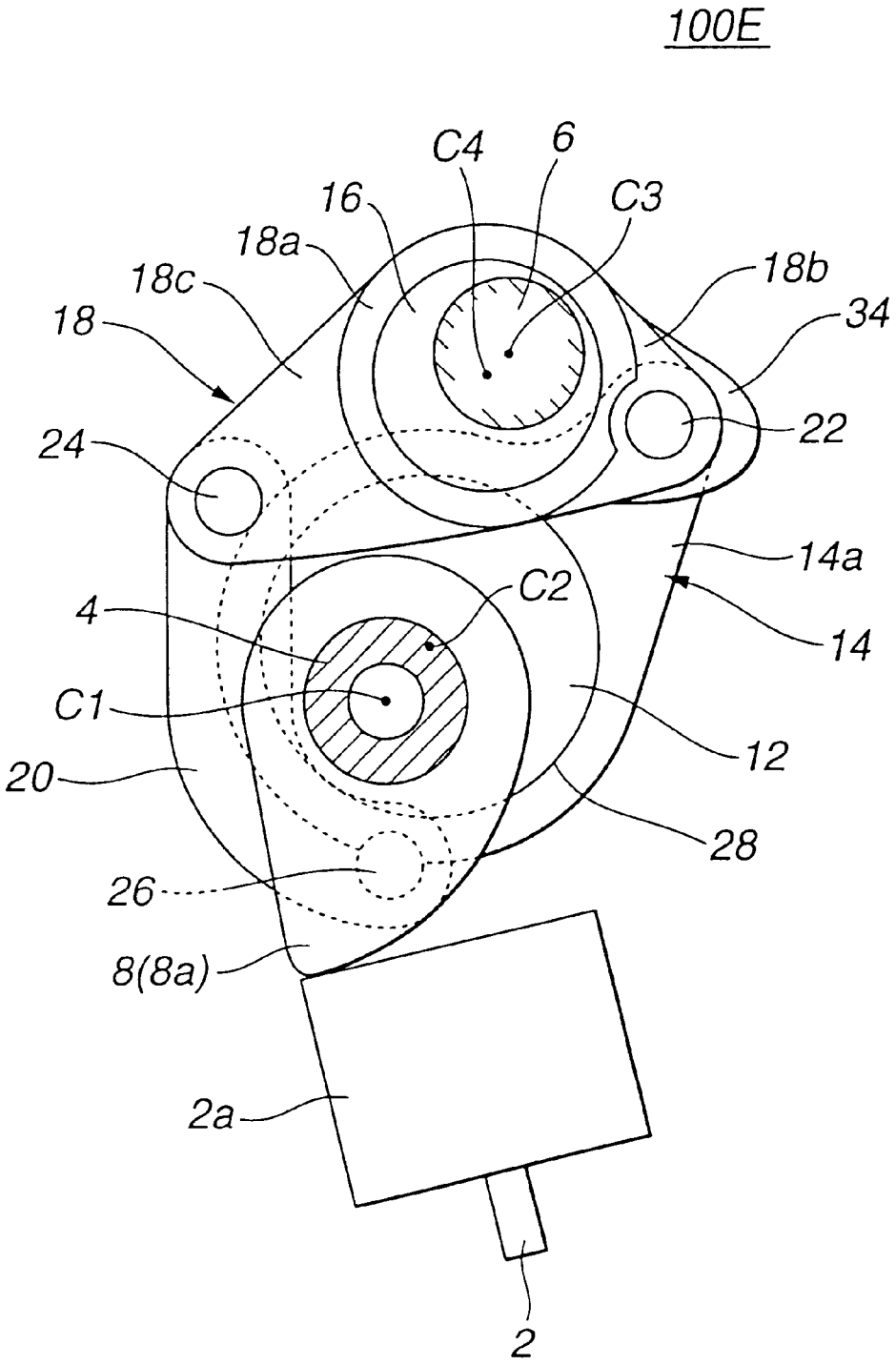
FIG. 11 is a sectional view taken along the line XI—XI of FIG. 10.

Referring to FIGS. 10 and 11, there is shown a variable valve mechanism 100E which is fifth embodiment of the present invention.

The mechanism 100E of this embodiment is substantially the same as that 100A of the first embodiment except the shape of the rocker arm 18. That is, as is seen from the drawings, in the fifth embodiment 100E, the first arm portion 18*b* of the rocker arm 18 is formed with an enlarged portion 34 which surrounds the inlet part of the fitting bore 18*d*.

In this fifth embodiment 100E, the advantages of the first embodiment 100A are obtained. Furthermore, due to provision of the enlarged portion 34, the supporting rigidity to the first connecting pin 22 is much increased, and due to the increased mutually contacting surfaces possessed by the first arm portion 18*b* and the ring-link 14, the undesired slant of the link 14 is much assuredly suppressed.

Figure 12:
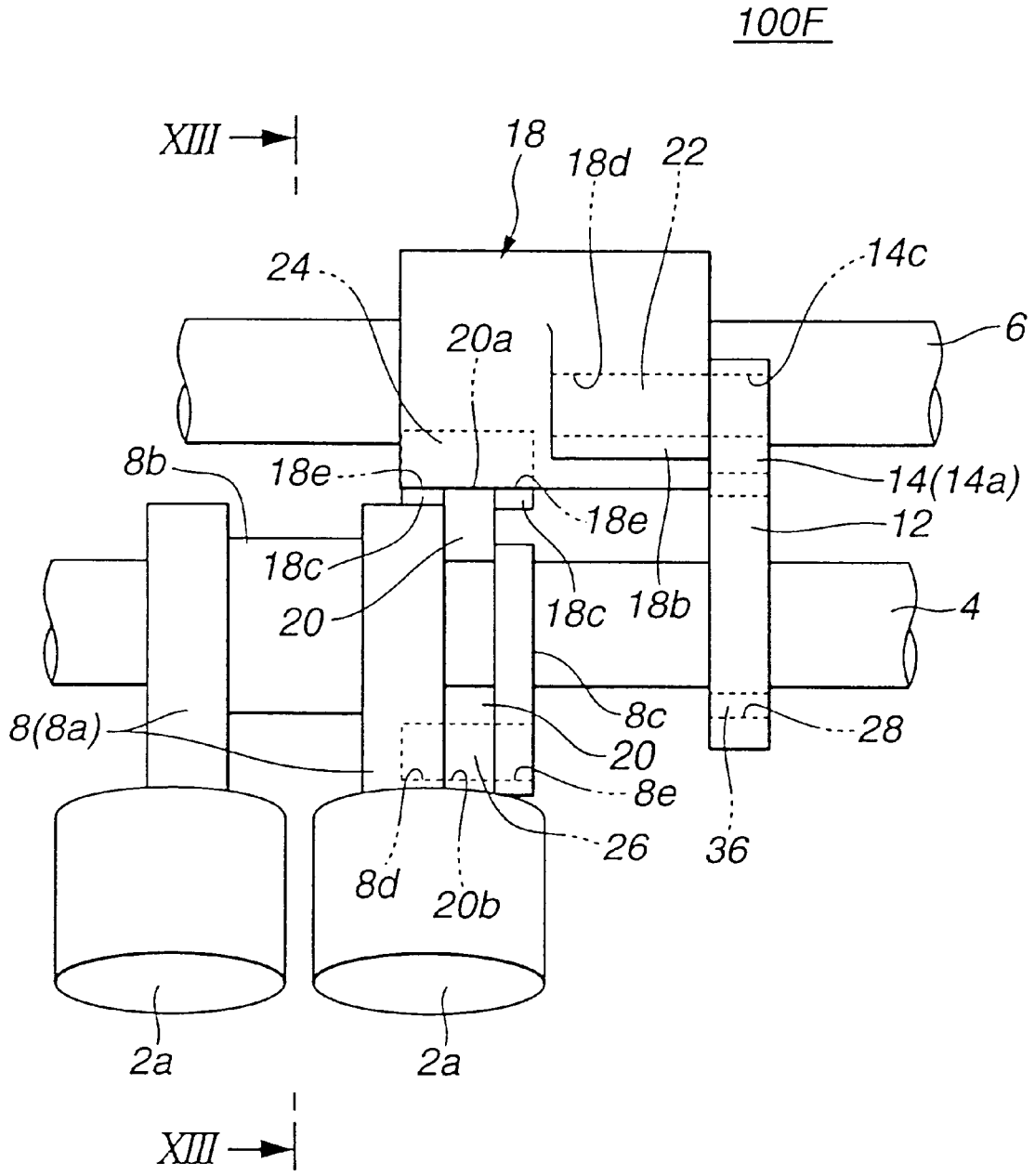
FIG. 12 is a view similar to FIG. 1, but showing a sixth embodiment of the present invention.
Figure 13:
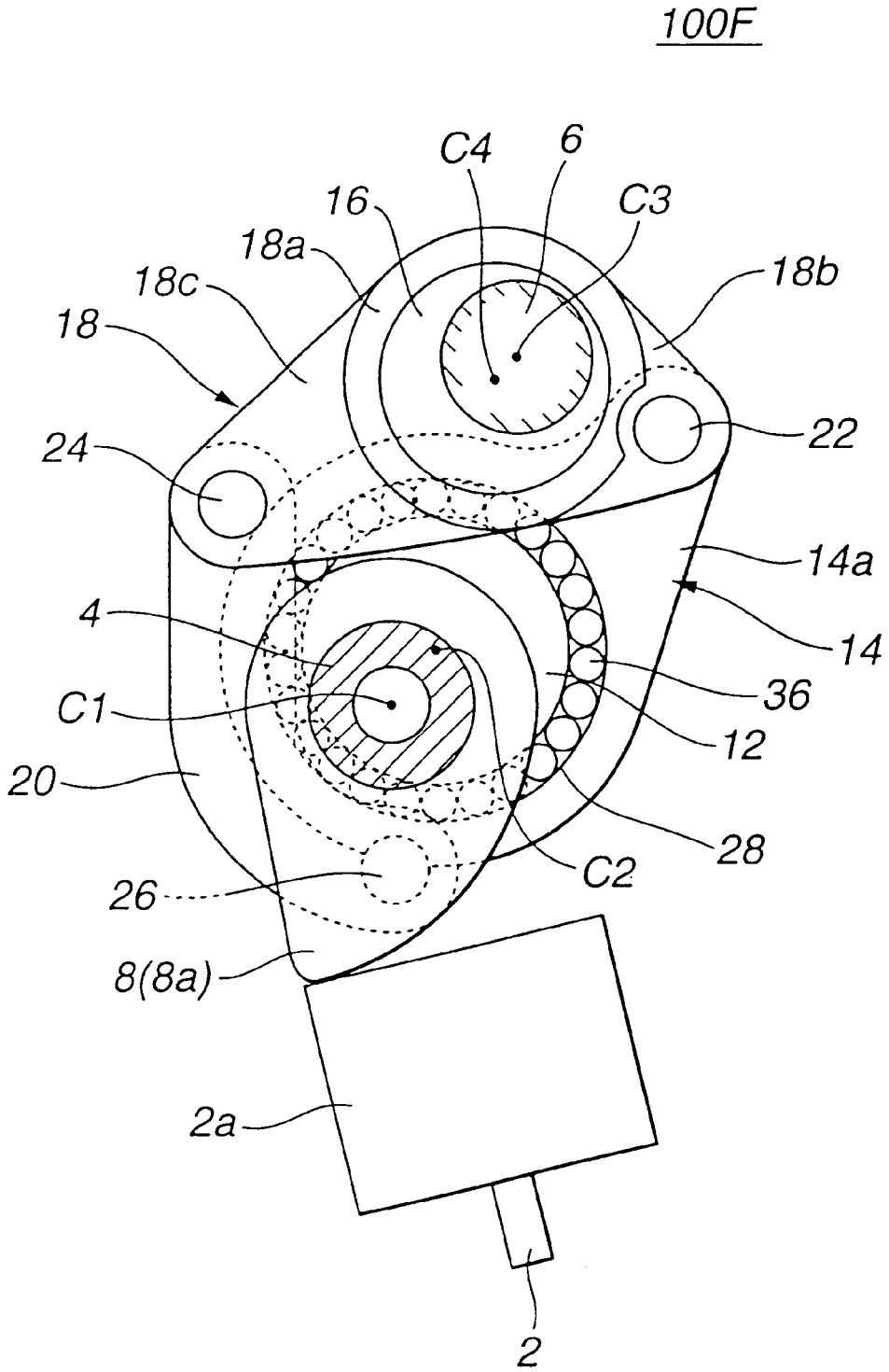
FIG. 13 is a sectional view taken along the line XIII—XIII of FIG. 12.

Referring to FIGS. 12 and 13, there is shown a variable valve mechanism 100F which is a sixth embodiment of the present invention.

In this sixth embodiment 100F, a needle bearing 36 is used at the bearing portion 28 between the first eccentric cam 12 and the ring-link 14. Due to usage of the needle bearing 36, the relative rotation between the first eccentric cam 12 and the ring-link 14 is much improved.

Figure 14:
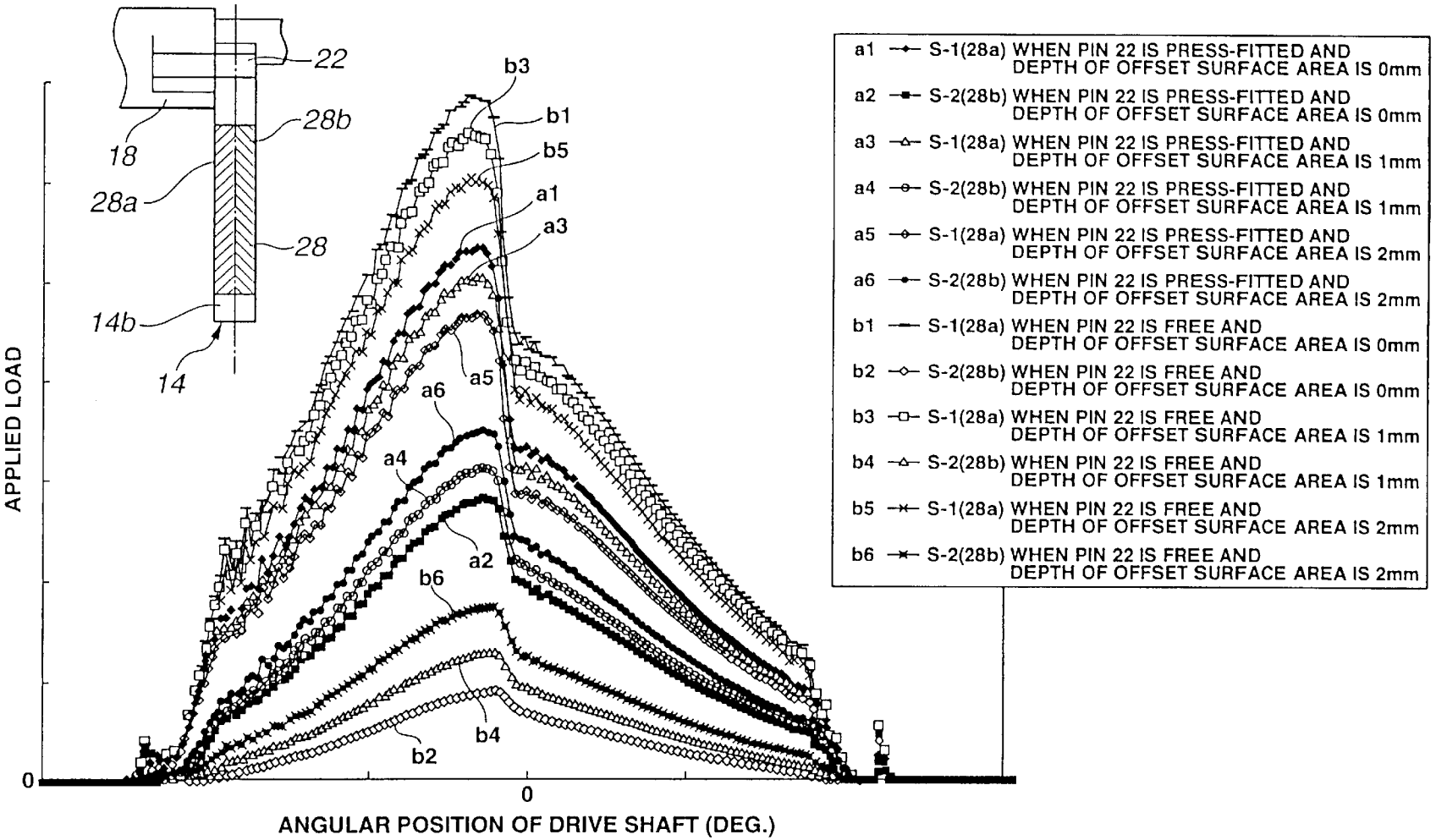
FIG. 14 is a graph showing loads applied to a bearing portion of a ring-link.

The advantages of the above-mentioned embodiments will become clear from the graph of FIG. 14 which shows calculated loads which would be applied to axially spaced two portions of the sliding bearing portion 28 of the rink-link 14, namely, left and right halves 28*a* and 28*b* of the bearing portion 28 with respect to an angular position of the drive shaft 4. It is to be noted that the possibility of the unsymmetrical wear of the bearing portion 28 lowers as the difference between sum S−1 of the loads applied to the left half 28*a* of the bearing portion 28 and sum S−2 of the loads applied to the right half 28*b* of the bearing portion 28 lowers. The curves denoted by "a1" to "a6" are results obtained from the mechanisms of the present invention wherein the first connecting pin 22 is fixed to the rocker arm 18, and the curves denoted by "b1" to "b6" are results obtained from reference mechanisms wherein the pin 22 is rotatable relative to the rocker arm 18. The curves "a1", "a3" and "a5" show the sum S−1 of loads applied to the left half 28*a* of the bearing portion 28 when the depth of the offset surface area 32 is 0 mm, 1 mm and 2 mm respectively, while the curves "a2", "a4" and "a6" show the sum S−2 of loads applied to the right half 28*b* of the bearing portion 28 when the depth of the offset surface area 32 is 0 mm, 1 mm and 2 mm respectively. Like this, the curves "b1", "b3" and "b5" show the sum S−1 of loads applied to the left half 28*a* of the bearing portion 28 when the depth of the offset surface area 32 is 0 mm, 1 mm and 2 mm respectively, while the curves "b2", "b4" and "b6" show the sum S−2 of loads applied to the right half 28*b* of the bearing portion 28 when the depth of the offset surface area 32 is 0 mm, 1 mm and 2 mm respectively. More specifically, the curves "a3" to "a6" and "b3" to "b6" are the results obtained from the mechanisms of a type wherein like in the above-mentioned third and fourth embodiments 100C and 100D, the ring-link 14 has an offset surface area 32 which faces the inlet portion of the fitting (or bearing) bore 18*d* of the rocker arm 18.

As is understood from this graph, when the degree of offset is the same, the results depicted by the curves "a1" to "a6" of the invention show a smaller difference between the sums S–1 and S–2 than that of the results depicted by the curves "b1" to "b6" of the reference mechanisms. That means that the undesirable unsymmetrical wear of the bearing portion 28 is effectively suppressed in accordance with the present invention. Furthermore, from the graph, it is understood that when the ring-link 14 has an offset surface area 32, the difference between the sums S–1 and S–2 becomes much small and thus the undesired unsymmetrical wear of the bearing portion 28 is much effectively suppressed.

The entire contents of Japanese Patent Application 2000-46872 (filed Feb. 24, 2000) are incorporated herein by reference.

Although the invention has been described above with reference to the embodiments of the invention, the invention is not limited to such embodiments as described above. Various modifications and variations of such embodiments may be carried out by those skilled in the art, in light of the above descriptions.

What is claimed is:

1. A variable valve mechanism of an internal combustion engine, comprising:

a drive shaft driven by the engine;

a control shaft extending in parallel with said drive shaft, said control shaft being rotatable about its axis to a given angular position in accordance with an operation condition of the engine;

a swing cam rotatably disposed about said drive shaft, said swing cam actuating engine valves;

a first eccentric cam tightly disposed on the drive shaft;

a first link rotatably disposed on said first eccentric cam;

a second eccentric cam tightly disposed on said control shaft;

a rocker arm rotatably disposed on said second eccentric cam;

a second link extending between said rocker arm and said swing cam;

a first connecting pin through which a first arm portion of said rocker arm and said first link are pivotally connected;

a second connecting pin through which a second arm portion of said rocker arm and an end of said second link are pivotally connected; and a third connecting pin through which the other end of said second link and said swing cam are pivotally connected, wherein said first link includes a surface facing the first arm portion of said rocker arm, the surface including an offset area that surrounds said first connecting pin, so that a part of the first connecting pin extends through a space between said rocker arm and said first link.

2. A variable valve mechanism as claimed in claim 1, in which said first arm portion of said rocker arm is formed with a fitting bore in which one axial end part of the first connecting pin is entirely fitted, and in which said first link is formed with a bearing bore in which the other axial end part of the first connecting pin rotatably received.

3. A variable valve mechanism as claimed in claim 2, in which the length of said one axial end part of the first connecting pin is longer than that of the other axial end part of the same.

4. A variable valve mechanism as claimed in claim 3, in which said first arm portion of said rocker arm is formed with a surface which is projected toward said offset surface area of the first link by a distance corresponding to the depth of the offset area, so that said surface is slidably contactable with the offset area.

5. A variable valve mechanism as claimed in claim 4, in which said first arm portion of said rocker arm is formed with an enlarged portion which surrounds the inlet part of said fitting bore.

6. A variable valve mechanism as claimed in claim 2, in which a needle bearing is operatively disposed between said first eccentric cam and said first link.

7. A variable valve mechanism as claimed in claim 2, in which said second connecting pin is pivotally held by both said second arm portion of said rocker arm and the other end of said second link, and in which said third connecting pin is pivotally held by both the other end of said second link and said swing cam.

8. A variable valve mechanism as claimed in claim 7, in which a first part of said first arm portion to which said one axial end part of the first connecting pin is secured has an axially enlarged thickness as compared with a second part of said first link to which the other axial end part of said first connecting pin is pivotally connected.

9. A variable valve mechanism as claimed in claim 8, in which said second part of said first link is formed with said offset area.

10. A variable valve mechanism as claimed in claim 2, in which said first arm portion of the rocker arm is enlarged in size at a part that surrounds said one axial end part of said first connecting pin.

* * * * *